US012024954B2

(12) United States Patent
Al-Mousa

(10) Patent No.: US 12,024,954 B2
(45) Date of Patent: Jul. 2, 2024

(54) METHOD AND SYSTEM FOR RESERVOIR MONITORING USING ELECTRICAL CONNECTORS WITH COMPLETION ASSEMBLIES

(71) Applicant: SAUDI ARABIAN OIL COMPANY, Dhahran (SA)

(72) Inventor: Ahmed Al-Mousa, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 156 days.

(21) Appl. No.: 17/456,941

(22) Filed: Nov. 30, 2021

(65) Prior Publication Data

US 2023/0167692 A1 Jun. 1, 2023

(51) Int. Cl.

| | |
|---|---|
| ***E21B 17/02*** | (2006.01) |
| ***E21B 31/12*** | (2006.01) |
| ***E21B 33/038*** | (2006.01) |
| ***E21B 34/16*** | (2006.01) |
| ***E21B 47/00*** | (2012.01) |
| ***E21B 47/07*** | (2012.01) |
| ***E21B 47/10*** | (2012.01) |
| ***E21B 49/08*** | (2006.01) |

(52) U.S. Cl.

CPC ..... *E21B 17/028* (2013.01); *E21B 31/12* (2013.01); *E21B 33/0385* (2013.01); *E21B 34/16* (2013.01); *E21B 47/00* (2013.01); *E21B 47/07* (2020.05); *E21B 47/10* (2013.01); *E21B 49/0875* (2020.05); *E21B 2200/02* (2020.05)

(58) Field of Classification Search

CPC ..... E21B 47/00; E21B 47/07; E21B 47/10; E21B 17/028; E21B 31/12; E21B 33/0385; E21B 34/16; E21B 49/0875; E21B 2200/02

See application file for complete search history.

(56) References Cited

U.S. PATENT DOCUMENTS

| | | | | |
|---|---|---|---|---|
| 4,585,287 | A * | 4/1986 | Ramsey | G02B 6/3816 439/588 |
| 10,233,732 | B2 * | 3/2019 | Sadek | E21B 43/305 |
| 2016/0312552 | A1 * | 10/2016 | Early | E21B 41/00 |
| 2018/0187502 | A1 * | 7/2018 | Cridland | E21B 23/10 |
| 2019/0162060 | A1 * | 5/2019 | Randall | E21B 34/14 |
| 2020/0056446 | A1 * | 2/2020 | Al-Mousa | E21B 33/1293 |

* cited by examiner

*Primary Examiner* — Nicole Coy
*Assistant Examiner* — Nicholas D Wlodarski
(74) *Attorney, Agent, or Firm* — Osha Bergman Watanabe & Burton LLP

(57) ABSTRACT

A system may include a control system disposed on a well surface, a casing disposed in a wellbore, a first electrical wiring coupled to the control system and the casing within a first section of the wellbore, and a second electrical wiring coupled to various flow control devices in a second section of the wellbore. The first section of the wellbore may be disposed at a first predetermined direction that is different than a second predetermined direction of the second section of the wellbore. The system may further include an electrical connector coupled to the first electrical wiring and the second electrical wiring. The electrical connector may include a mechanical receiver that couples with the first electrical wiring, and a stinger assembly coupled with the second electrical wiring and that connects to the mechanical receiver.

18 Claims, 9 Drawing Sheets

METHOD AND SYSTEM FOR RESERVOIR MONITORING USING ELECTRICAL CONNECTORS WITH COMPLETION ASSEMBLIES

BACKGROUND

Various unconventional reservoirs may have autonomous well equipment that operates without any communication with equipment on a well surface. However, during the life of a reservoir, reservoir properties may change, such as the situation where a water or gas breakthrough occurs in a production zone in a horizontal well section. Without forming an electrical connection with well surface equipment, changes in an unconventional reservoir may not be detected at the well surface. Likewise, it may provide difficult to adjust production parameters to account for changes in subsurface reservoir properties without accurate reservoir knowledge regarding the state of a horizontal well section or a deviated well section.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a system that includes a control system disposed on a well surface, a casing disposed in a wellbore, a first electrical wiring coupled to the control system and the casing within a first section of the wellbore, and a second electrical wiring coupled to various flow control devices in a second section of the wellbore. The first section of the wellbore is disposed at a first predetermined direction that is different than a second predetermined direction of the second section of the wellbore. The system further includes an electrical connector coupled to the first electrical wiring and the second electrical wiring. The electrical connector includes a mechanical receiver that couples with the first electrical wiring, and a stinger assembly coupled with the second electrical wiring and that connects to the mechanical receiver.

In general, in one aspect, embodiments relate to an apparatus that includes a mechanical receiver coupled to a first conduit, a stinger assembly coupled with a second conduit, and a sealed case. The stinger assembly forms an electrical connection between a first electrical wiring in the first conduit and a second electrical wiring in the second conduit in response to being inserted into the mechanical receiver. The stinger assembly requires a predetermined tensile force for removal of the stinger assembly from the mechanical receiver.

In general, in one aspect, embodiments relate to a method that includes obtaining, by a control system and using an electrical connector coupled to various sensor devices disposed in a wellbore, sensor data regarding a geological region of interest. The wellbore includes a first section that includes a first electrical wiring coupled to the control system through a wellhead and a second section including a second electrical wiring coupled to the sensor devices. The electrical connector includes a mechanical receiver coupled to the first electrical wiring and a stinger assembly coupled with the second electrical wiring. The first section of the wellbore is disposed at a first predetermined direction that is different than a second predetermined direction of the second section of the wellbore. The method further includes transmitting, using the control system, a command to a well device based on the sensor data.

In some embodiments, the electrical connector includes a sealed case, a latch, and a spring actuator coupled to the latch. The latch may require a predetermined tensile force for removal of the stinger assembly from the mechanical receiver. In some embodiments, the stinger assembly includes a snap-in-rotate-out stinger. In some embodiments, electrical wiring is coupled to the control system using an electric line extraction tool, and the electric line extraction tool includes a hook assembly, an extension arm, a display device, and an input device that may control the hook assembly and the extension arm using a user input. In some embodiments, the first section of the wellbore corresponds to a vertical well path through a subsurface, where the second section of the wellbore corresponds to a horizontal well path through the subsurface, and flow control devices are disposed in the second section of the wellbore during a well completion operation. In some embodiments, a flow control device among various flow control devices is selected from a group consisting of an inflow control device (ICD), an autonomous inflow control device (AICD), and an autonomous inflow control valve (AICV). The flow control device may include one or more sensors that are selected from a group consisting of a flow meter, a phase saturation sensor, a phase velocity sensor, a pressure sensor, and a temperature sensor. In some embodiments, a casing centralizer is disposed in the first section of the wellbore. The casing centralizer may dispose a casing at a predetermined distance from a wall of the wellbore, and a titanium conduit may be coupled to the casing centralizer and include the first electrical wiring. The casing centralizer may allow passage of the titanium conduit and the first electrical wiring through the casing centralizer. In some embodiments, a casing shoe is coupled to the casing and disposed in the wellbore, where the electrical connector is disposed between the casing shoe and the well surface. In some embodiments, a liner assembly includes a liner and a liner hanger coupled to the liner, where the second electrical wiring is disposed in the liner in the second section of the wellbore, and where the electrical connector is disposed between the liner hanger and a casing shoe. In some embodiments, a reservoir simulator is coupled to the control system, where the control system stores sensor data regarding flow control devices, and the reservoir simulator performs one or more reservoir simulations that describe changes in one or more pressure drops across one or more flow control devices. In some embodiments, various sensor devices are disposed along the second section of the wellbore, and a production tree is coupled the wellbore. The control system may store sensor data regarding the sensor devices. The control system may determine, using the sensor data, a change in reservoir pressure for a geological region of interest comprising the wellbore. The control system may transmit one or more commands to adjust one or more parameters of one or more production operations based on the sensor data. In some embodiments, an electrical connector includes a latch and a spring actuator coupled to the latch, where the latch requires a predetermined tensile force for removal of the stinger assembly from the mechanical receiver. In some embodiments, the stinger assembly includes a stinger selected from a group consisting of a snap-in-rotate-out stinger, a snap-in-snap-out stinger, and a bullnose stinger. In some embodiments, a reservoir simulation is performed for a geological region of interest using the sensor data. a predicted production rate for one or more wells in the geological region of interest may be determined using the reservoir simulation. In some embodiments, a command changes one or more production parameters of a production operation at the wellbore. In some embodiments, second sensor data regarding various flow control devices in a wellbore is obtained by a control system and using an electrical connector. In some embodiments, whether a phase breakthrough has occurred in a wellbore among various flow control devices is determined by the control system and using sensor data.

In light of the structure and functions described above, embodiments of the invention may include respective means adapted to carry out various steps and functions defined above in accordance with one or more aspects and any one of the embodiments of one or more aspect described herein.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for monitoring one or more deviated sections of a wellbore, such as a horizontal production interval after a well completion and without any well intervention operations. In some embodiments, a reservoir monitoring system uses one or more electrical connectors to form electrical connections between electrical wiring within a vertical section of a wellbore and electrical wiring in a horizontal or deviated section of the wellbore. In particular, an electrical connector may use a mechanical receiver and a stinger assembly to connect electrical wiring in different conduits in a wellbore. For example, one conduit may couple electrical wiring between a stinger and well equipment in a deviated well (e.g., flow control devices, such as inflow control devices (ICDs), and downhole sensor devices), while another conduit may couple electrical wiring to one or more control systems on a well's surface. Thus, the electrical connector may be a downhole connector that electrically connects across production casing and a lower completion liner.

Furthermore, some embodiments provide a reservoir monitoring system that does not require mobilization of E-line or coil tubing for production logging operations. The reservoir monitoring system may implement real time continuous data acquisition that may produce improved reservoir modelling of an unconventional reservoir. In offshore well operations, for example, the reservoir monitoring system may eliminate the need for a barge to perform production logging. Likewise, some reservoir monitoring systems may continuously measure various reservoir production parameters using sensor data across a complete horizontal interval during the lifetime of the reservoir.

Figure 1:
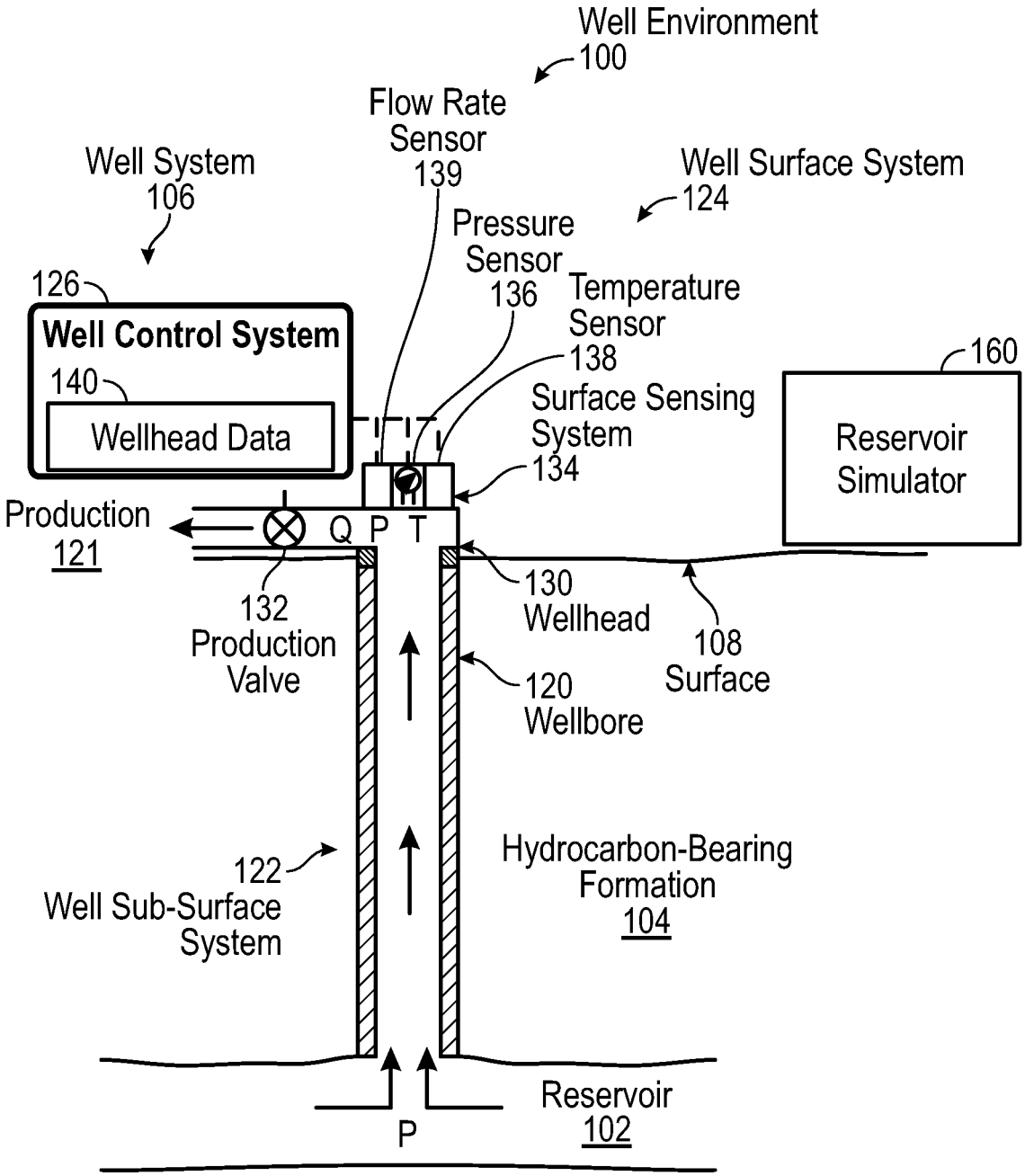
FIGS. 1, 2, 3A, 3B, 3C, 3D, 4A, 4B, 4C, 4D, and 5 show systems in accordance with one or more embodiments.

Turning to FIG. 1, FIG. 1 shows a schematic diagram in accordance with one or more embodiments. As shown in FIG. 1, FIG. 1 illustrates a well environment (100) that includes a hydrocarbon reservoir ("reservoir") (102) located in a subsurface hydrocarbon-bearing formation (104) and a well system (106). The hydrocarbon-bearing formation (104) may include a porous or fractured rock formation that resides underground, beneath the earth's surface ("surface") (108). In the case of the well system (106) being a hydrocarbon well, the reservoir (102) may include a portion of the hydrocarbon-bearing formation (104). The hydrocarbon-bearing formation (104) and the reservoir (102) may include different layers of rock having varying characteristics, such as varying degrees of permeability, porosity, and resistivity. In the case of the well system (106) being operated as a production well, the well system (106) may facilitate the extraction of hydrocarbons (or "production") from the reservoir (102).

In some embodiments, the well system (106) includes a wellbore (120), a well sub-surface system (122), a well surface system (124), and a well control system (126). The control system (126) may control various operations of the well system (106), such as well production operations, well completion operations, well maintenance operations, and reservoir monitoring, assessment and development operations. In some embodiments, the control system (126) includes a computer system that is the same as or similar to that of computer system (702) described below in FIG. 7 and the accompanying description.

The wellbore (120) may include a bored hole that extends from the surface (108) into a target zone of the hydrocarbon-bearing formation (104), such as the reservoir (102). An upper end of the wellbore (120), terminating at or near the surface (108), may be referred to as the "up-hole" end of the wellbore (120), and a lower end of the wellbore, terminating in the hydrocarbon-bearing formation (104), may be referred to as the "downhole" end of the wellbore (120). The wellbore (120) may facilitate the circulation of drilling fluids during drilling operations, the flow of hydrocarbon production ("production") (121) (e.g., oil and gas) from the reservoir (102) to the surface (108) during production operations, the injection of substances (e.g., water) into the hydrocarbon-bearing formation (104) or the reservoir (102) during injection operations, or the communication of monitoring devices (e.g., logging tools) into the hydrocarbon-bearing formation (104) or the reservoir (102) during monitoring operations (e.g., during in situ logging operations).

In some embodiments, during operation of the well system (106), the control system (126) collects and records wellhead data (140) for the well system (106) and other data regarding downhole equipment and downhole sensors (e.g., using a reservoir monitoring system described below in FIG. 2 and the accompanying description). The wellhead data (140) may include, for example, a record of measurements of wellhead pressure (P) (e.g., including flowing wellhead pressure (FWHP)), wellhead temperature (T) (e.g., including flowing wellhead temperature), wellhead production rate (Q) over some or all of the life of the well (106), and water cut data. In some embodiments, the measurements are recorded in real-time, and are available for review or use within seconds, minutes or hours of the condition being sensed (e.g., the measurements are available within 1 hour of the condition being sensed). In such an embodiment, the wellhead data (140) may be referred to as "real-time" wellhead data (140). Real-time wellhead data (140) may enable an operator of the well (106) to assess a relatively current state of the well system (106), and make real-time decisions regarding development of the well system (106) and the reservoir (102), such as on-demand adjustments in regulation of production flow from the well.

With respect to water cut data, the well system (106) may include one or more water cut sensors. For example, a water cut sensor may be hardware and/or software with functionality for determining the water content in oil, also referred to as "water cut." Measurements from a water cut sensor may be referred to as water cut data and may describe the ratio of water produced from the wellbore (120) compared to the total volume of liquids produced from the wellbore (120). In some embodiments, a water-to-gas ratio (WGR) is determined using a multiphase flow meter. For example, a multiphase flow meter may use magnetic resonance information to determine the number of hydrogen atoms in a particular fluid flow. Since oil, gas and water all contain hydrogen atoms, a multiphase flow may be measured using magnetic resonance. In particular, a fluid may be magnetized and subsequently excited by radio frequency pulses. The hydrogen atoms may respond to the pulses and emit echoes that are subsequently recorded and analyzed by the multiphase flow meter.

In some embodiments, the well surface system (124) includes a wellhead (130). The wellhead (130) may include a rigid structure installed at the "up-hole" end of the wellbore (120), at or near where the wellbore (120) terminates at the Earth's surface (108). The wellhead (130) may include structures for supporting (or "hanging") casing and production tubing extending into the wellbore (120). Production (121) may flow through the wellhead (130), after exiting the wellbore (120) and the well sub-surface system (122), including, for example, the casing and the production tubing. In some embodiments, the well surface system (124) includes flow regulating devices that are operable to control the flow of substances into and out of the wellbore (120). For example, the well surface system (124) may include one or more production valves (132) that are operable to control the flow of production (134). For example, a production valve (132) may be fully opened to enable unrestricted flow of production (121) from the wellbore (120), the production valve (132) may be partially opened to partially restrict (or "throttle") the flow of production (121) from the wellbore (120), and production valve (132) may be fully closed to fully restrict (or "block") the flow of production (121) from the wellbore (120), and through the well surface system (124).

Keeping with FIG. 1, in some embodiments, the well surface system (124) includes a surface sensing system (134). The surface sensing system (134) may include sensor devices for sensing characteristics of substances, including production (121), passing through or otherwise located in the well surface system (124). The characteristics may include, for example, pressure, temperature and flow rate of production (121) flowing through the wellhead (130), or other conduits of the well surface system (124), after exiting the wellbore (120).

In some embodiments, the surface sensing system (134) includes a surface pressure sensor (136) operable to sense the pressure of production (151) flowing through the well surface system (124), after it exits the wellbore (120). The surface pressure sensor (136) may include, for example, a wellhead pressure sensor that senses a pressure of production (121) flowing through or otherwise located in the wellhead (130). In some embodiments, the surface sensing system (134) includes a surface temperature sensor (138) operable to sense the temperature of production (151) flowing through the well surface system (124), after it exits the wellbore (120). The surface temperature sensor (138) may include, for example, a wellhead temperature sensor that senses a temperature of production (121) flowing through or otherwise located in the wellhead (130), referred to as "wellhead temperature" (T). In some embodiments, the surface sensing system (134) includes a flow rate sensor (139) operable to sense the flow rate of production (151) flowing through the well surface system (124), after it exits the wellbore (120). The flow rate sensor (139) may include hardware that senses a flow rate of production (121) (Q) passing through the wellhead (130).

Keeping with FIG. 1, when completing a well, one or more well completion operations may be performed prior to delivering the well to the party responsible for production or injection. Well completion operations may include casing operations, cementing operations, perforating the well, gravel packing, directional drilling, hydraulic stimulation of a reservoir region, and/or installing a production tree or wellhead assembly at the wellbore (120). Likewise, well operations may include open-hole completions or cased-hole completions. For example, an open-hole completion may refer to a well that is drilled to the top of the hydrocarbon reservoir. Thus, the well is cased at the top of the reservoir, and left open at the bottom of a wellbore. In contrast, cased-hole completions may include running casing into a reservoir region.

In one well completion example, the sides of the wellbore (120) may require support, and thus casing may be inserted into the wellbore (120) to provide such support. After a well has been drilled, casing may ensure that the wellbore (120) does not close in upon itself, while also protecting the wellstream from outside incumbents, like water or sand. Likewise, if the formation is firm, casing may include a solid string of steel pipe that is run on the well and will remain that way during the life of the well. In some embodiments, the casing includes a wire screen liner that blocks loose sand from entering the wellbore (120).

In another well operation example, a space between the casing and the untreated sides of the wellbore (120) may be cemented to hold a casing in place. This well operation may include pumping cement slurry into the wellbore (120) to displace existing drilling fluid and fill in this space between the casing and the untreated sides of the wellbore (120). Cement slurry may include a mixture of various additives and cement. After the cement slurry is left to harden, cement may seal the wellbore (120) from non-hydrocarbons that attempt to enter the wellstream. In some embodiments, the cement slurry is forced through a lower end of the casing and into an annulus between the casing and a wall of the wellbore (120). More specifically, a cementing plug may be used for pushing the cement slurry from the casing. For example, the cementing plug may be a rubber plug used to separate cement slurry from other fluids, reducing contamination and maintaining predictable slurry performance. A displacement fluid, such as water, or an appropriately weighted drilling fluid, may be pumped into the casing above the cementing plug. This displacement fluid may be pressurized fluid that serves to urge the cementing plug downward through the casing to extrude the cement from the casing outlet and back up into the annulus.

Keeping with well operations, some embodiments include perforation operations. More specifically, a perforation operation may include perforating casing and cement at different locations in the wellbore (120) to enable hydrocarbons to enter a wellstream from the resulting holes. For example, some perforation operations include using a perforation gun at different reservoir levels to produce holed sections through the casing, cement, and sides of the wellbore (120). Hydrocarbons may then enter the wellstream through these holed sections. In some embodiments, perforation operations are performed using discharging jets or shaped explosive charges to penetrate the casing around the wellbore (120).

In another well completion, a filtration system may be installed in the wellbore (120) in order to prevent sand and other debris from entering the wellstream. For example, a gravel packing operation may be performed using a gravel-packing slurry of appropriately sized pieces of coarse sand or gravel. As such, the gravel-packing slurry may be pumped into the wellbore (120) between a casing's slotted liner and the sides of the wellbore (120). The slotted liner and the gravel pack may filter sand and other debris that might have otherwise entered the wellstream with hydrocarbons. In another well completion, a wellhead assembly may be installed on the wellhead of the wellbore (120). A wellhead assembly may be a production tree (also called a Christmas tree) that includes valves, gauges, and other components to provide surface control of subsurface conditions of a well.

In some embodiments, a wellbore (120) includes one or more casing centralizers. For example, a casing centralizer may be a mechanical device that secures casing at various locations in a wellbore to prevent casing from contacting the walls of the wellbore. Thus, casing centralization may produce a continuous annular clearance around casing such that cement may be used to completely seal the casing to walls of the wellbore. Without casing centralization, a cementing operation may experience mud channeling and poor zonal isolation. Examples of casing centralizers may include bow-spring centralizers, rigid centralizers, semi-rigid centralizers, and mold-on centralizers. In particular, bow springs may be slightly larger than a particular wellbore in order to provide complete centralization in vertical or slightly deviated wells. On the other hand, rigid centralizers may be manufactured from solid steel bar or cast iron with a fixed blade height in order to fit a specific casing or hole size. Rigid centralizers may perform well even in deviated wellbores regardless of any particular side forces. Semi-rigid centralizers may be made of double crested bows and operate as a hybrid centralizer that includes features of both bow-spring and rigid centralizers. The spring characteristic of the bow-spring centralizers may allow the semi-rigid centralizers to compress in order to be disposed in tight spots in a wellbore. Mold-on centralizers may have blades made of carbon fiber ceramic material that can be applied directly to a casing surface.

In some embodiments, well intervention operations may also be performed at a well site. For example, well intervention operations may include various operations carried out by one or more service entities for an oil or gas well during its productive life (e.g., fracking operations, CT, flow back, separator, pumping, wellhead and production tree maintenance, slickline, braded line, coiled tubing, snubbing, workover, subsea well intervention, etc.). For example, well intervention activities may be similar to well completion operations, well delivery operations, and/or drilling operations in order to modify the state of a well or well geometry. In some embodiments, well intervention operations are used to provide well diagnostics, and/or manage the production of the well. With respect to service entities, a service entity may be a company or other actor that performs one or more types of oil field services, such as well operations, at a well site. For example, one or more service entities may be responsible for performing a cementing operation in the wellbore (120) prior to delivering the well to a producing entity.

Turning to the reservoir simulator (160), a reservoir simulator (160) may include hardware and/or software with functionality for storing and analyzing well logs, production data, sensor data (e.g., from a wellhead, downhole sensor devices, or flow control devices), and/or other types of data to generate and/or update one or more geological models of one or more reservoir regions. Geological models may include geochemical or geomechanical models that describe structural relationships within a particular geological region. Likewise, a reservoir simulator (160) may also determine changes in reservoir pressure and other reservoir properties for a geological region of interest, e.g., in order to evaluate the health of a particular reservoir during the lifetime of one or more producing wells.

While the reservoir simulator (160) is shown at a well site, in some embodiments, the reservoir simulator (160) or other components in FIG. 1 may be remote from a well site. In some embodiments, the reservoir simulator (160) is implemented as part of a software platform for the well control system (126). The software platform may obtain data acquired by a control system as inputs, which may include multiple data types from multiple sources. The software platform may aggregate the data from these systems in real time for rapid analysis. In some embodiments, the well control system (126) and the reservoir simulator (160), and/or a user device coupled to one of these systems may include a computer system that is similar to the computer system (702) described below with regard to FIG. 7 and the accompanying description.

Figure 2:
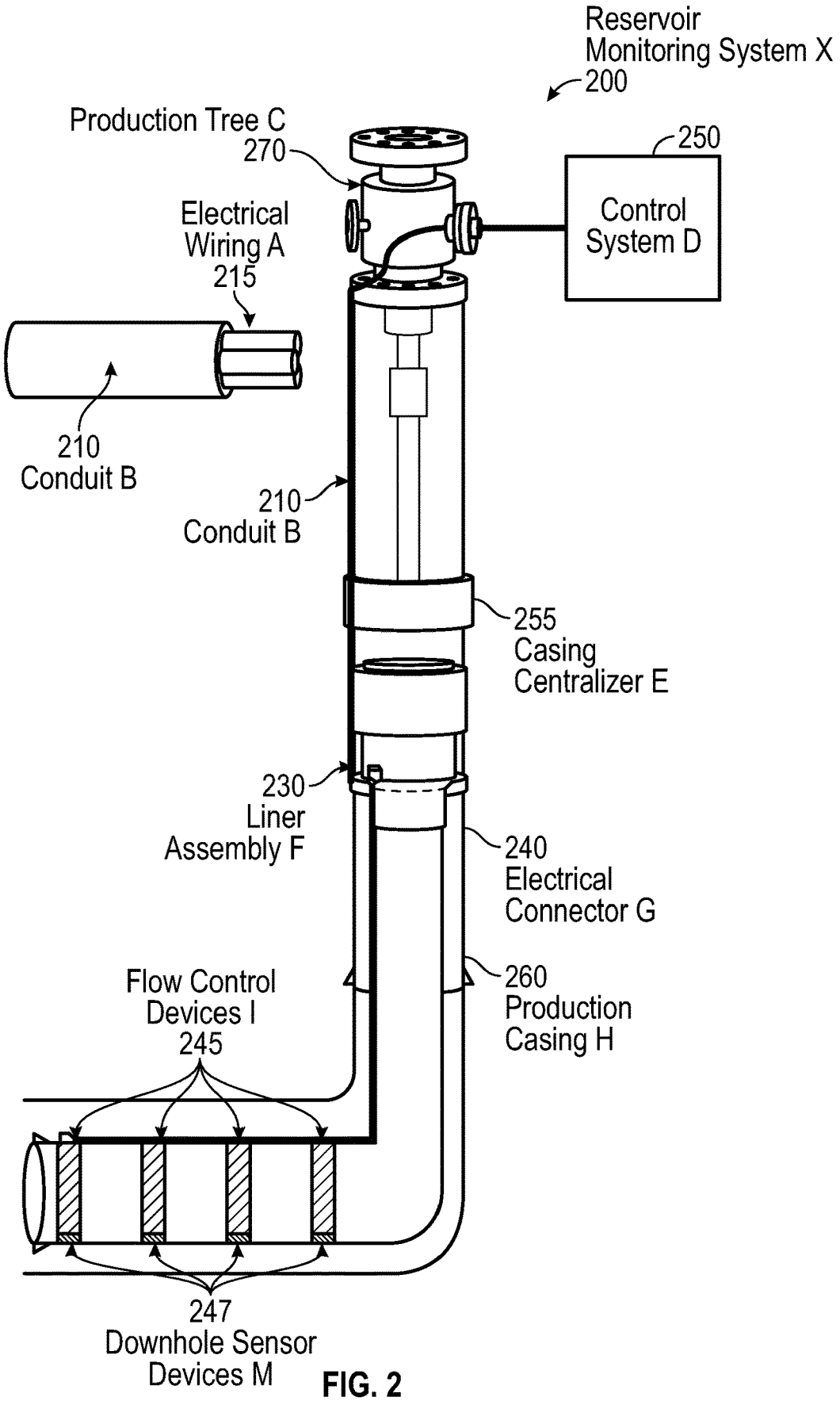

Turning to FIG. 2, FIG. 2 shows a schematic diagram in accordance with one or more embodiments. As illustrated in FIG. 2, a reservoir monitoring system (e.g., reservoir monitoring system X (200)) may include one or more control systems (e.g. control system D (250)), a production tree (e.g., production tree C (270)), one or more casing centralizers (e.g., casing centralizer E (255)), a liner assembly (e.g., liner assembly F (230)), and production casing (e.g., production casing H (260)). In some embodiments, a conduit (e.g., conduit B (210)) includes electrical wiring (e.g., electrical wiring A (215)) that connects a control system on a well surface to an electrical connector (e.g., electrical connector G (240)). The electrical connector may also couple electrical wiring from one or more control systems to downhole equipment, such as flow control devices (e.g., flow control devices I (245)) and various sensors (e.g., downhole sensor devices M (247)) in a downhole section of a wellbore.

In some embodiments, production casing (e.g., production casing H (260)) is coupled with a conduit (e.g., conduit B (210)) for running electrical wire inside the wellbore. For example, a conduit may include a titanium case, where this titanium conduit may be 0.25 inches in diameter and protect internal electrical wiring (e.g., electrical wiring A (215)) from a well's corrosive environment. The conduit may also avoid damage to electrical wiring during a well operation that includes running casing in a wellbore. Moreover, various casing centralizers (e.g., casing centralizer E (255)) may be used to centralize the casing while allowing passage of the conduit through the wellbore. For example, a casing centralizer may have a special hole prepared for insertion of the conduit with electrical wiring.

In some embodiments, an electrical connector is disposed within or coupled to a liner assembly in a well. For example, a liner assembly may include one or more liners, one or more liner hangers, one or more collars (e.g., a setting collar or a landing collar), and/or a liner hanger packer. A liner hanger may include hardware that secures and supports one or more liners in a wellbore. The liner hanger may include mechanical slips that grip the inside of a casing at a particular location, e.g., a pre-determined distance above a casing shoe. More specifically, space between a liner hanger and a casing shoe may be referred to as a liner lap. Liner hangers may include hydraulically-set liner hangers, mechanically-set liner hangers, rotating liner hangers, or a tight liner assembly, or a hybrid system that is a mixture of methods. As such, liners may be cemented back to the liner hanger. A mechanical liner hanger may include a mechanically-set liner hanger that is operated in combination with a setting collar or a liner top packer. A hydraulic liner hanger may include slips for highly deviated holes where liner rotation may prove difficult. A liner may be a slotted liner that is installed in casing to serve as a strainer against the passage of sand into production fluid. A liner assembly may also include sand control adapters (SCA) that prevent formation sands from entering the wellbore and serve as a liner top tool entry guide. In order to obtain a good cement bond between a liner and a formation, a particular cement slurry flow may be achieved in an annulus during a cementing operation.

Figure 3A:
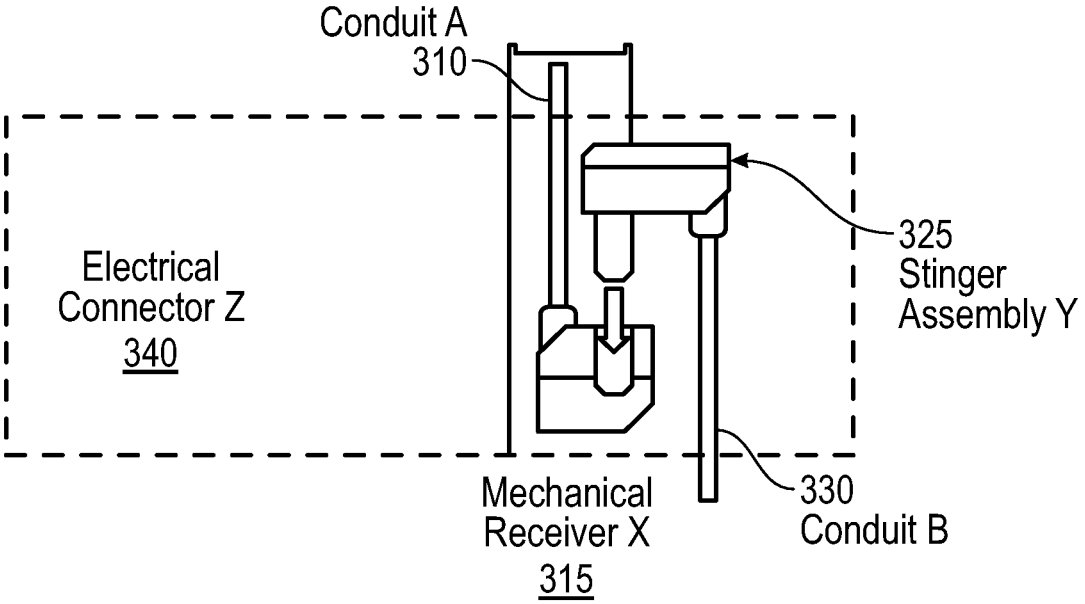

Turning to FIGS. 3A, 3B, 3C, and 3D, FIGS. 3A-3D show schematic diagrams in accordance with one or more embodiments. In FIG. 3A, an electrical connector Z (340) includes a mechanical receiver X (315) and a stinger assembly Y (325) at 200 feet above a production casing shoe (not shown). A conduit A (310) is coupled to the mechanical receiver X (315), while a conduit B (330) is connected to the stinger assembly Y (325). The electric connection within the electrical connector Z (340) is protected with a sealed case, where mechanical coupling between the stinger assembly Y (325) and the mechanical receiver X (315) may be produced using a spring actuator to protect the electric connection from downhole fluids and corrosive environment.

Turning to stinger assemblies, a stinger assembly may include a stinger that may be retrieved using a straight pickup and/or a rotation with a straight pickup. For example, a stinger assembly may include a seal receptacle (e.g., using O-rings) that engages once the stinger is inserted into a mechanical receiver. Examples of different types of stingers may include a snap-in-rotate-out stinger, a snap-in-snap-out stinger, and a bullnose stinger. A snap-in-rotate-out stinger may prevent an electrical connection from disengaging when being set with hydraulic pressure. To install a snap-in-rotate-out stinger, a downweight may be set on the stinger to snap a latch into the mechanical receiver. To remove the snap-in-rotate-out stinger, a predetermined tensile force may be applied to a tubing while rotating the tubing according to a predetermined direction. With respect to a snap-in-snap-out stinger, a downweight may be set on the stinger to snap a latch into the mechanical receiver. To release the stinger from the mechanical receiver, a predetermined tensile force may be applied over a casing string weight. This tensile force may release the stinger from the mechanical receiver. On the other hand, a bullnose stinger may not use any latching mechanism, but may overcome seal drag to install or remove the stinger from the mechanical receiver.

Figure 3B:
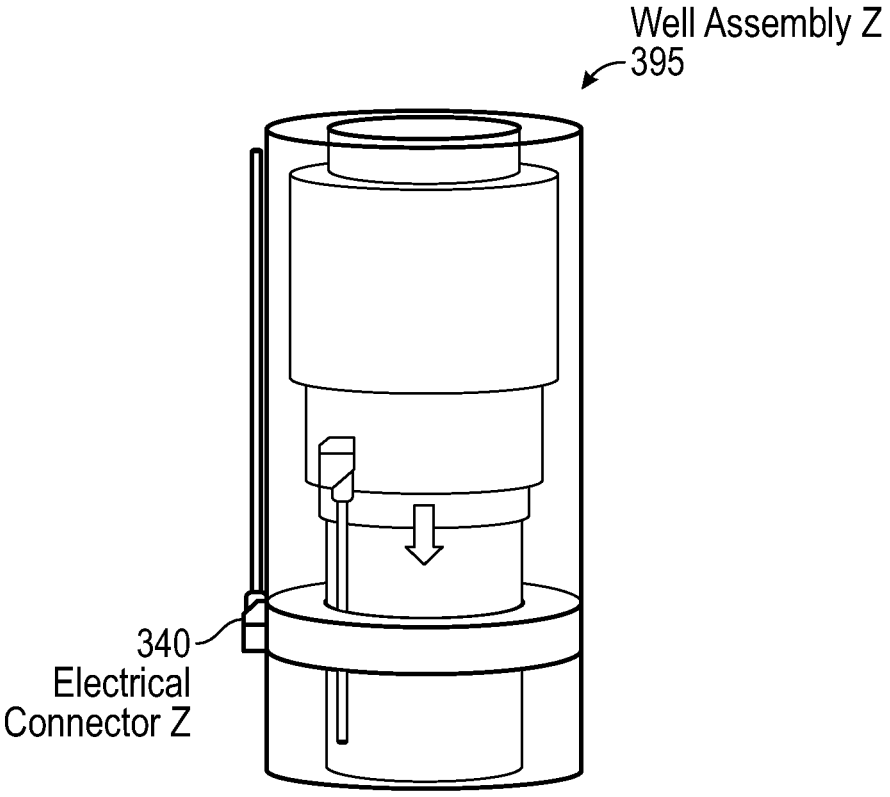
Figure 3C:
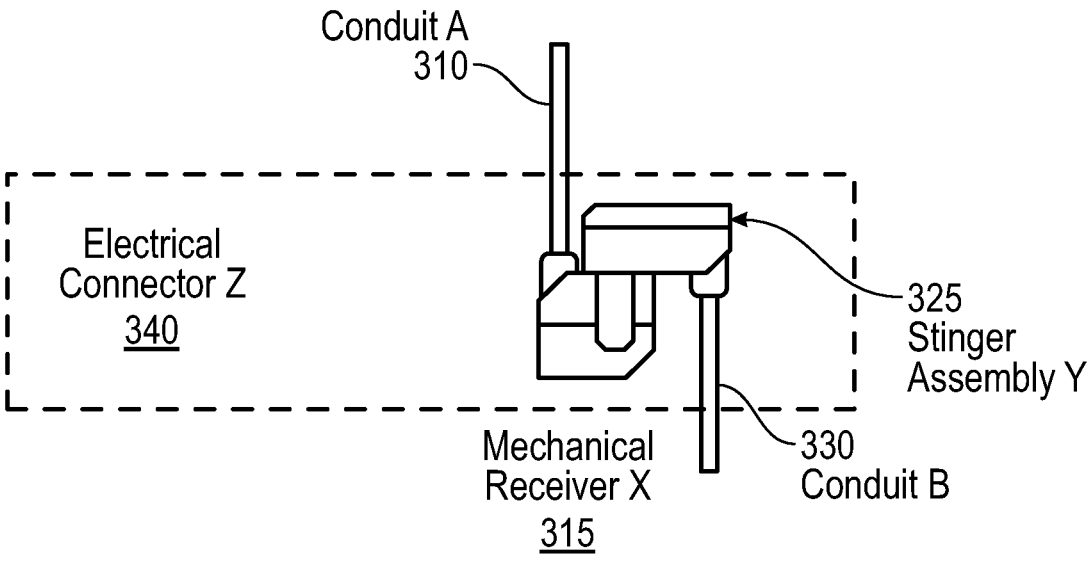
Figure 3D:
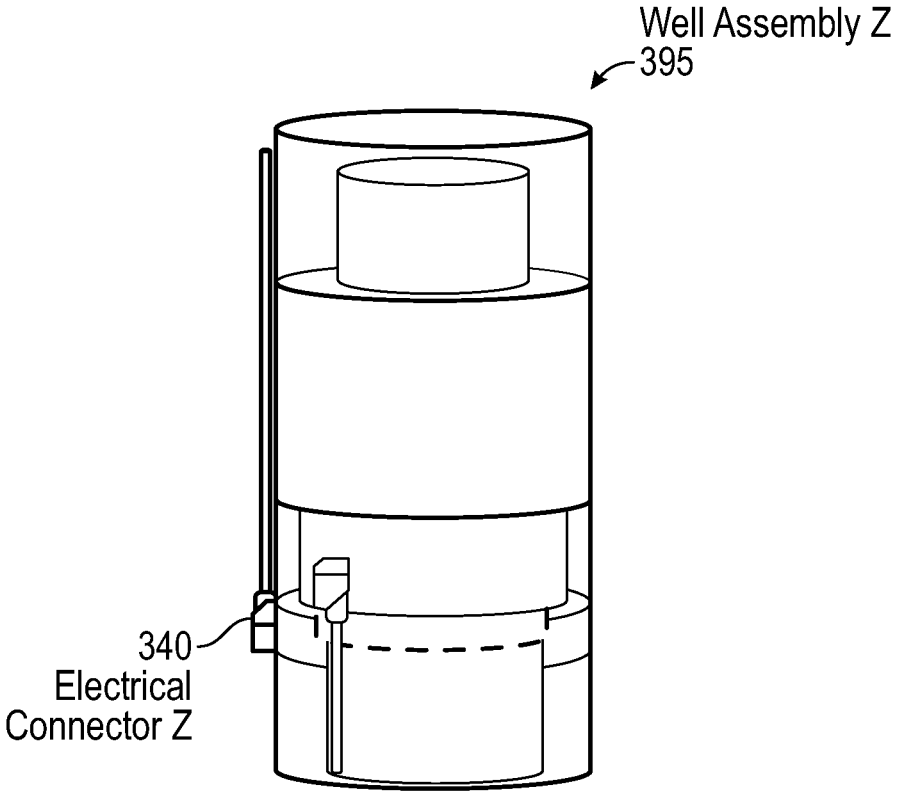

Turning to FIG. 3B, the electrical connector Z (340) is shown as disengaged, i.e., mechanical receiver X (315) is separated from stinger assembly Y (325), within a well assembly Z (395). In FIG. 3C, mechanical receiver X (315) and stinger assembly Y (325) are engaged, thereby producing an electrical connection between electrical wiring in conduit A (310) and electrical wiring in conduit B (330). In FIG. 3D, the electrical connector Z (340) is shown engaged within well assembly Z (395). Thus, the electrical connector Z (340) may produce a continuous electric circuit between one or more lower completion sections of a well system. Once the stinger assembly Y (325) inserts into the mechanical receiver X (315), a continuous electric path may be established that connects well surface data equipment, such as a data acquisition control system, to downhole tools.

Returning to FIG. 2, a reservoir monitoring system (e.g., reservoir monitoring system X (200)) may include hardware and/or software with functionality for communicating with various flow control devices in one or more deviated well sections. Flow control devices may include flow meters, phase saturation sensor, phase velocity sensor, pressure sensors, and/or temperature sensors. In some embodiments, flow control devices include one or more inflow control devices (ICDs), one or more autonomous inflow control devices (AICDs), and/or one or more autonomous inflow control valve (AICVs). In particular, an ICD may be a device installed in a horizontal well section that prevents excessive production of gas, water or both. For example, an ICD may include a screen that controls excessive sand production or restricts fluid from passing through the ICD. As such, an ICD may be a passive system that operates without any commands from a well surface. Examples of ICDs may include channel-type ICDs, nozzle-type ICDs, and hybrid-channel ICDs. A channel-type ICD may use surface friction to generate pressure drops when a fluid flow passes through a channel with a defined length, and then to the opening before entering the wellbore. A nozzle-type ICD may provide one or more fluid restrictions to generate a desired pressure drop, where fluid may be forced to pass through a small opening (e.g., an orifice) that generates flow resistance. A hybrid-channel ICD may combine technology from channel-type and nozzle-type ICDs.

Turning to AICDs, AICDs may include hardware that provides both passive ICD completion and also further restrictions of unwanted fluid from a wellbore after gas or water breakthrough into the wellbore. In a horizontal well, for example, an AICD valve may choke the flow of low-viscous fluids while allowing passage of a higher-viscous fluid. AICDs may be based on various technologies, such as electrical resistivity (ER-AICD), fluidic diode AICDs, and rate controlled production AICDs (RCP-AICD).

Turning to AICVs, an AICV may be an AICD with functionality for preventing completely the inflow of unwanted fluid in the wellbore from a particular reservoir region. More specifically, an AICV may include two flow paths, i.e., a pilot flow path and main flow path that both end in an outlet of a valve. When fluid is passing through the AICV, most of the reservoir fluid may traverse the main flow path and a small percentage of the reservoir fluid may pass though the pilot path. The pilot path may include that shut offs a liquid flow in the main flow path based on reservoir pressure.

Figure 4A:
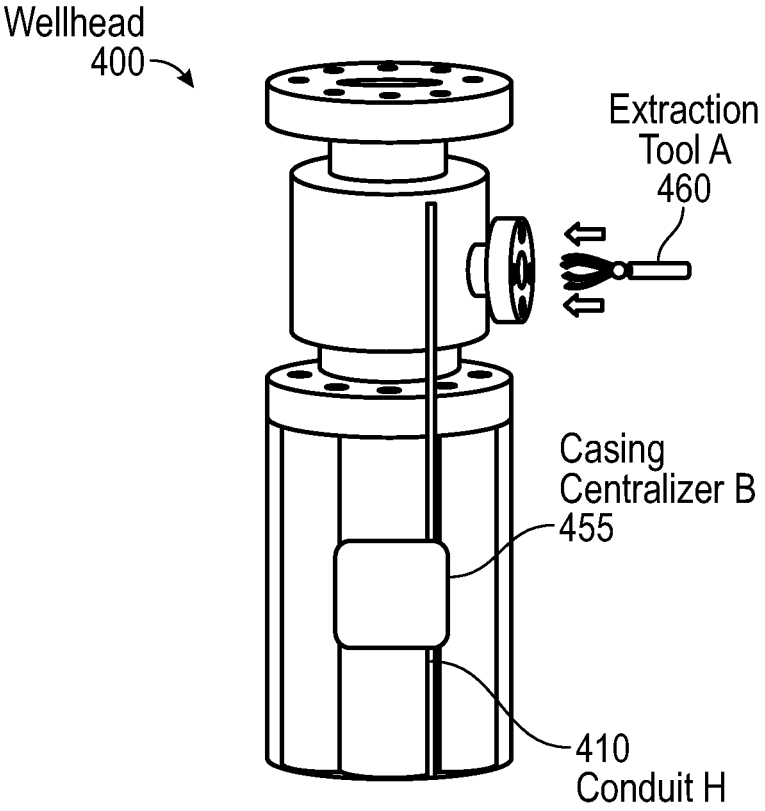
Figure 4B:
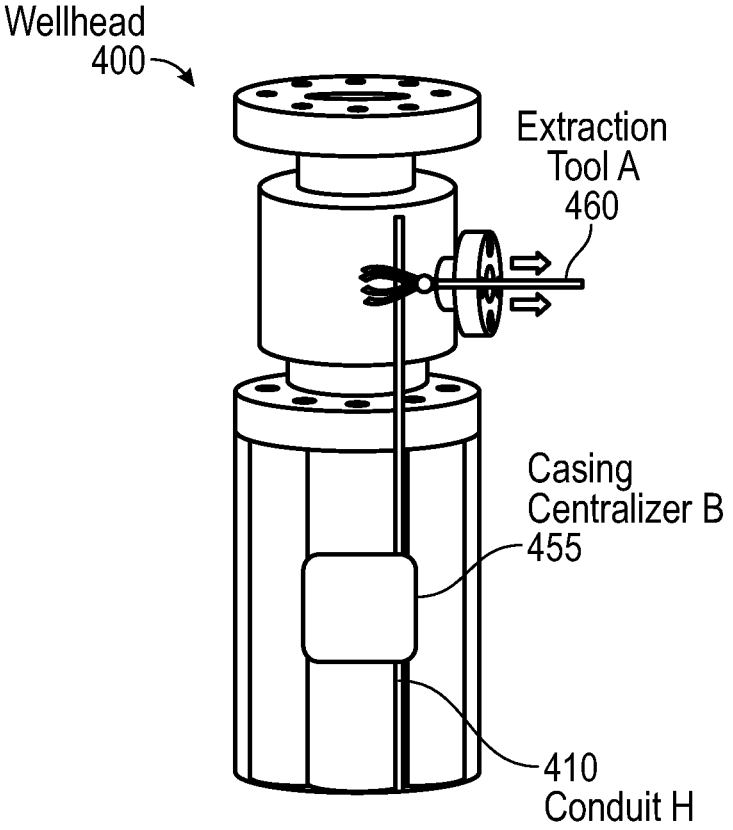
Figure 4C:
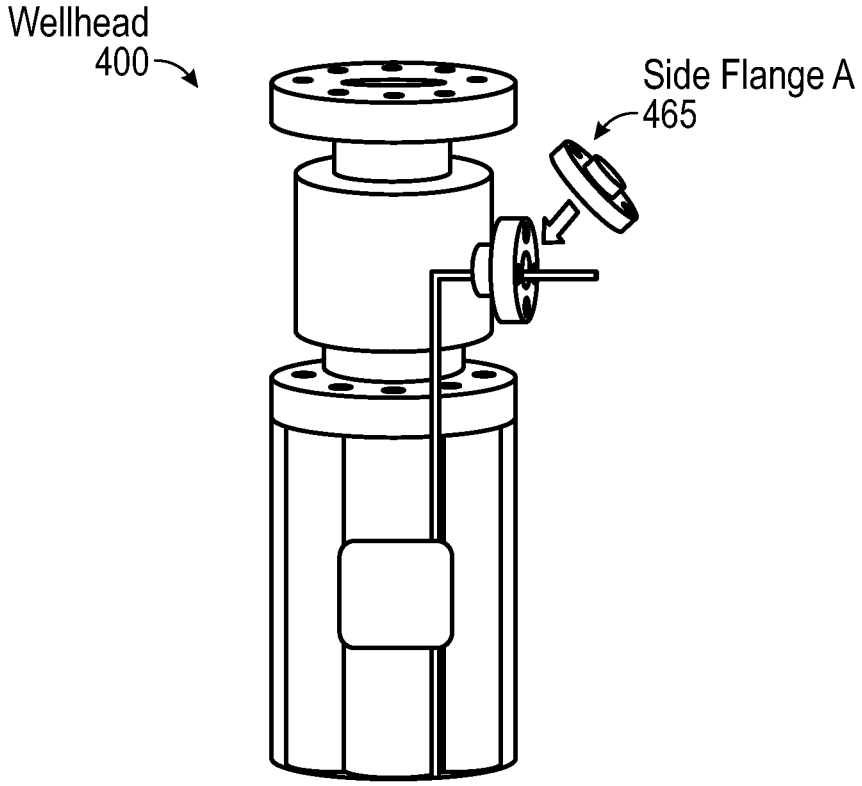
Figure 4D:
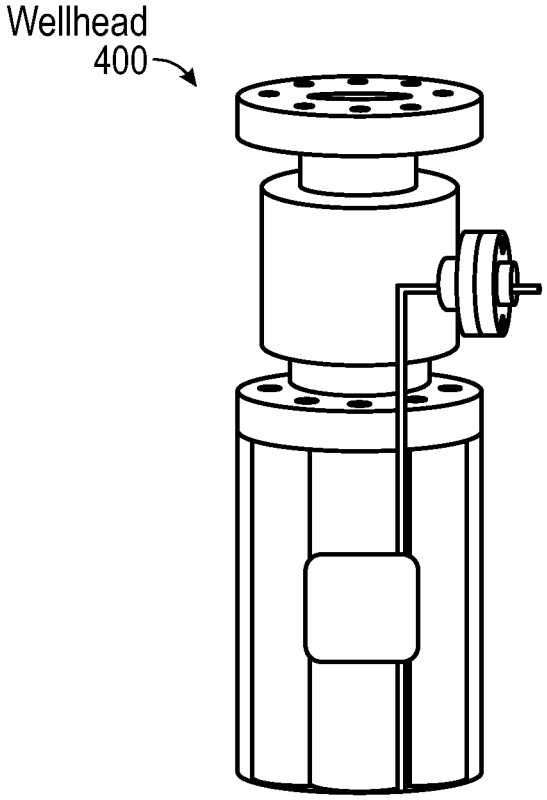

Turning to FIGS. 4A, 4B, 4C, and 4D, FIGS. 4A-4D show schematic diagrams in accordance with one or more embodiments. In FIG. 4A, a wellhead (400) includes a production casing spool that is penetrated by an extraction tool A (460) at a side flange A (465). This extraction tool A (460) may connect well surface equipment (e.g., for a data acquisition control system) with electrical wiring that is coupled to downhole electrical wiring using an electrical connector as described above in FIGS. 2 and 3 and the accompanying description. Similar to FIG. 2, a conduit H (410) pass through a casing centralizer B (455) to couple with an electric connector, where the conduit H (410) include electrical wiring (not shown). In particular, FIGS. 4A, 4B, 4C, and 4D illustrate how the extraction tool A (460) removes electrical wiring from the wellhead (400) and a conduit H (410).

Figure 5:
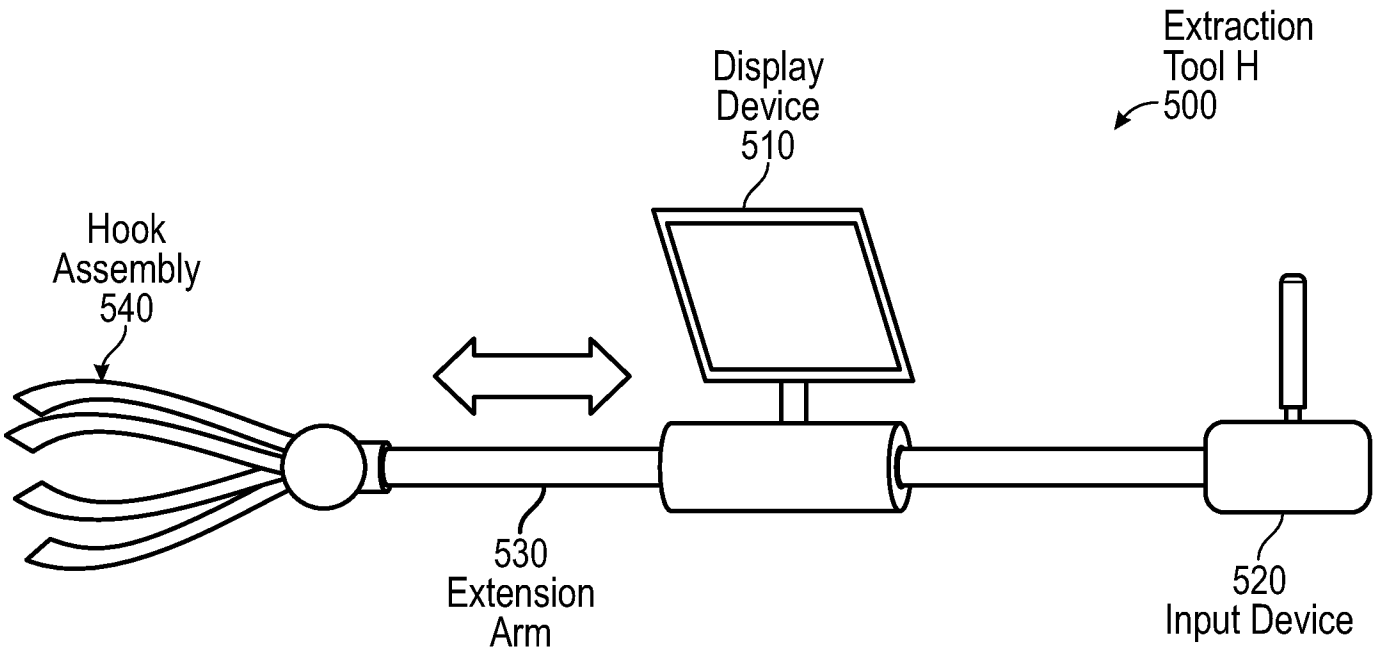

Turning to FIG. 5, FIG. 5 shows an extraction tool in accordance with one or more embodiments. In FIG. 5, an extraction tool H (500) includes a display device (510), a hook assembly (540), an extension arm (530), and an input device (520). For example, the hook assembly (540) may include one or more moveable fingers for fastening to a conduit or electrical wiring inside a production tree. The input device may be a joystick or other user controller with hardware for controlling a hook assembly and the extension arm using one or more user inputs. The extension arm (530) may be an adjustable limb for reaching a conduit or electrical wiring a predetermined distance inside a production tree. Using one or more user inputs, a user may extract electrical wiring from a well using the hook assembly (540).

Returning to FIG. 2, a control system (e.g., control system D (250)) may be a data acquisition control system. For example, the control system may include hardware and/or software for collecting sensor data and equipment data from flow control devices (e.g., flow control devices I (245)) and/or various well sensors (e.g., downhole sensor devices M (247)). The control system may include one or more programmable logic controllers (PLCs) that include hardware and/or software with functionality to control one or more processes performed by reservoir monitoring system (e.g., reservoir monitoring system X (200)). In particular, a programmable logic controller may be a ruggedized computer system with functionality to withstand vibrations, extreme temperatures, wet conditions, and/or dusty conditions, for example, around a drilling rig or a well site. In some embodiments, the control system includes functionality for controlling one or more well operations such as production operations, at a well site. For example, a programmable logic controller may control valve states, fluid levels, pipe pressures, warning alarms, and/or pressure releases throughout well equipment. Without loss of generality, the term "control system" may refer to a production operation control system that is used to operate and control well equipment, a data acquisition control system that is used to acquire well data and/or sensor data to monitor well operations, or a well interpretation software system that is used to analyze and understand well events and production progress. In some embodiments, the control system D (250) may include a computer system that is similar to the computer system (702) and/or the well control system (126) described with respect to FIGS. 1 and 7 and the accompanying description, respectively.

While FIGS. 1, 2, 3A, 3B, 3C, 3D, 4A, 4B, 4C, 4D, and 5 shows various configurations of hardware components and/or software components, other configurations may be used without departing from the scope of the disclosure. For example, various components in FIGS. 1, 2, 3A, 3B, 3C, 3D, 4A, 4B, 4C, 4D, and 5 may be combined to create a single component. As another example, the functionality performed by a single component may be performed by two or more components.

Figure 6:
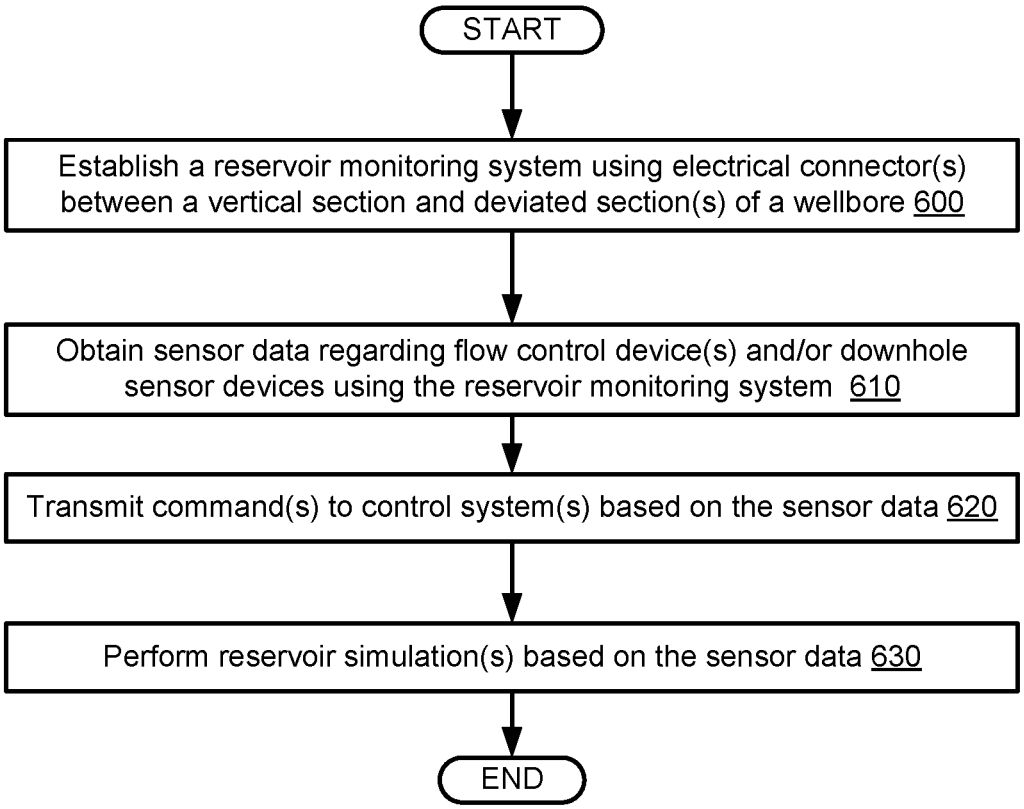
FIG. 6 shows a flowchart in accordance with one or more embodiments.

Turning to FIG. 6, FIG. 6 shows a flowchart in accordance with one or more embodiments. Specifically, FIG. 6 describes a general method for using a reservoir monitoring system. One or more blocks in FIG. 6 may be performed by one or more components (e.g., reservoir simulator (160) or control system D (250)) as described in FIGS. 1, 2, 3A, 3B, 3C, 3D, 4A, 4B, 4C, 4D, and 5. While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 600, a reservoir monitoring system is established using one or more electrical connectors between a vertical section and one or more deviated sections of a wellbore in accordance with one or more embodiments. In some embodiments, for example, an electrical connector is similar to the electrical connectors describes above in FIGS. 2, 3A, 3B, 3C, and 3D and the accompanying description. Likewise, electrical wiring from a conduit may be coupled to a control system using an extraction tool similar to the extraction tool described above in FIGS. 4A, 4B, 4C, 4D, and 5 and the accompanying description.

In Block 610, sensor data regarding one or more flow control devices and/or one or more downhole sensor devices are obtained using a reservoir monitoring system in accordance with one or more embodiments. In particular, sensor data may include viscosity data, flow rate data, temperature data, and other sensor data types. Likewise, the sensor data may describe a geological region of interest, such as a horizontal interval inside an unconventional reservoir. In other words, a geological region of interest may be a portion of a geological area or volume that includes one or more formations of interest desired or selected for analysis, e.g., for determining changes in reservoir properties of a deviated section of a well.

In Block 620, one or more commands are transmitted to one or more control systems based on sensor data in accordance with one or more embodiments. In some embodiments, for example, a control system transmits one or more commands to various well devices in a well system in order to produce a particular production operations with specific production parameters (e.g., wellhead temperature, reservoir pressure, production rate, a particular water-gas ratio, a particular water cut level, etc.). Commands may include data messages transmitted over one or more network protocols using a network interface, such as through wireless data packets. Likewise, a command may also be a control signal, such as an analog electrical signal, that triggers one or more operations in a particular control system.

In Block 630, one or more reservoir simulations are performed based on sensor data in accordance with one or more embodiments. For example, a reservoir simulator may use sensor data from a reservoir monitoring system to solve well equations and reservoir equations in a particular simulation. Reservoir simulations may include history matching, predicting production rates at one or more wells, and/or determining the presence of hydrocarbon-producing formations for new wells. Likewise, various reservoir simulation applications may be performed, such as rankings, uncertainty analyses, sensitivity analyses, and/or well-by-well history matching. With respect to history matching, the objective may be to fit measured historical data to a reservoir model. In some embodiments, one or more reservoir simulations may optimize production for a well or group of wells, provide well design parameters for one or more wells, and completion operations for one or more wells (e.g., using which down-hole devices).

Figure 7:
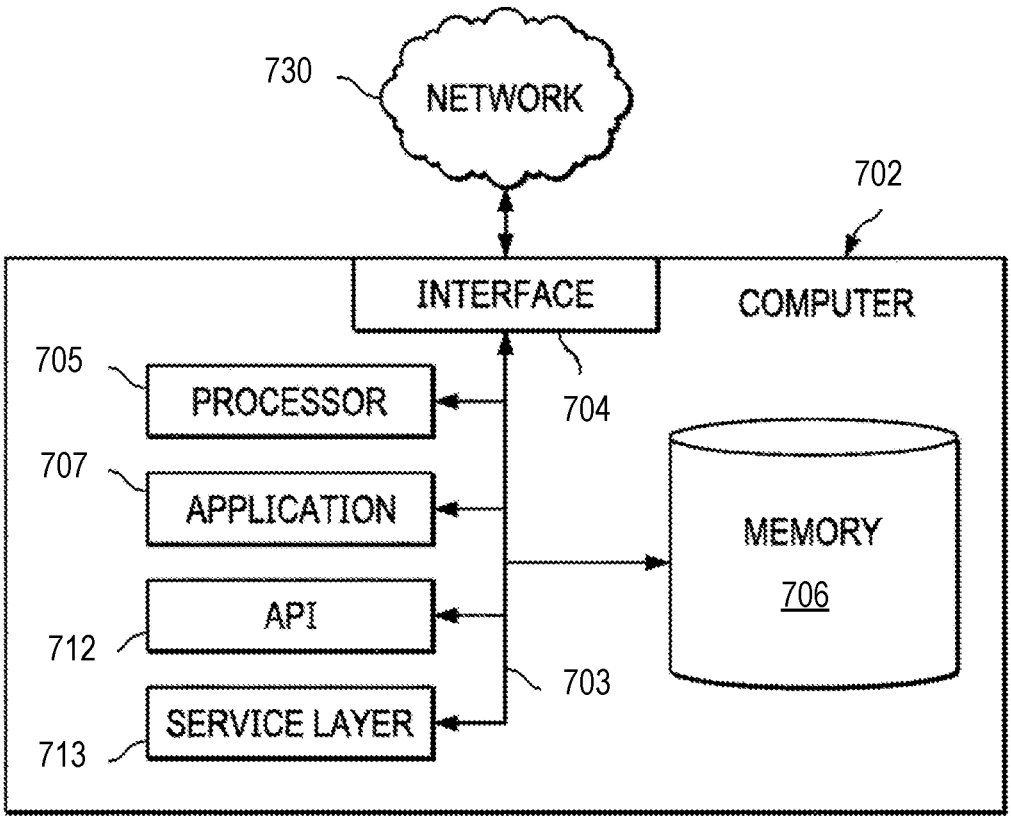
FIG. 7 shows a computer system in accordance with one or more embodiments.

Embodiments may be implemented on a computer system. FIG. 7 is a block diagram of a computer system (702) used to provide computational functionalities associated with described algorithms, methods, functions, processes, flows, and procedures as described in the instant disclosure, according to an implementation. The illustrated computer (702) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (702) may include a computer that includes an input device, such as a keypad, keyboard, touch screen, or other device that can accept user information, and an output device that conveys information associated with the operation of the computer (702), including digital data, visual, or audio information (or a combination of information), or a GUI.

The computer (702) can serve in a role as a client, network component, a server, a database or other persistency, or any other component (or a combination of roles) of a computer system for performing the subject matter described in the instant disclosure. The illustrated computer (702) is communicably coupled with a network (730). In some implementations, one or more components of the computer (702) may be configured to operate within environments, including cloud-computing-based, local, global, or other environment (or a combination of environments).

At a high level, the computer (702) is an electronic computing device operable to receive, transmit, process, store, or manage data and information associated with the described subject matter. According to some implementations, the computer (702) may also include or be communicably coupled with an application server, e-mail server, web server, caching server, streaming data server, business intelligence (BI) server, or other server (or a combination of servers).

The computer (702) can receive requests over network (730) from a client application (for example, executing on another computer (702)) and responding to the received requests by processing the said requests in an appropriate software application. In addition, requests may also be sent to the computer (702) from internal users (for example, from a command console or by other appropriate access method), external or third-parties, other automated applications, as well as any other appropriate entities, individuals, systems, or computers.

Each of the components of the computer (702) can communicate using a system bus (703). In some implementations, any or all of the components of the computer (702), both hardware or software (or a combination of hardware and software), may interface with each other or the interface (704) (or a combination of both) over the system bus (703) using an application programming interface (API) (712) or a service layer (713) (or a combination of the API (712) and service layer (713). The API (712) may include specifications for routines, data structures, and object classes. The API (712) may be either computer-language independent or dependent and refer to a complete interface, a single function, or even a set of APIs. The service layer (713) provides software services to the computer (702) or other components (whether or not illustrated) that are communicably coupled to the computer (702). The functionality of the computer (702) may be accessible for all service consumers using this service layer. Software services, such as those provided by the service layer (713), provide reusable, defined business functionalities through a defined interface. For example, the interface may be software written in JAVA, C++, or other suitable language providing data in extensible markup language (XML) format or other suitable format. While illustrated as an integrated component of the computer (702), alternative implementations may illustrate the API (712) or the service layer (713) as stand-alone components in relation to other components of the computer (702) or other components (whether or not illustrated) that are communicably coupled to the computer (702). Moreover, any or all parts of the API (712) or the service layer (713) may be implemented as child or sub-modules of another software module, enterprise application, or hardware module without departing from the scope of this disclosure.

The computer (702) includes an interface (704). Although illustrated as a single interface (704) in FIG. 7, two or more interfaces (704) may be used according to particular needs, desires, or particular implementations of the computer (702). The interface (704) is used by the computer (702) for communicating with other systems in a distributed environment that are connected to the network (730). Generally, the interface (704 includes logic encoded in software or hardware (or a combination of software and hardware) and operable to communicate with the network (730). More specifically, the interface (704) may include software supporting one or more communication protocols associated with communications such that the network (730) or interface's hardware is operable to communicate physical signals within and outside of the illustrated computer (702).

The computer (702) includes at least one computer processor (705). Although illustrated as a single computer processor (705) in FIG. 7, two or more processors may be used according to particular needs, desires, or particular implementations of the computer (702). Generally, the computer processor (705) executes instructions and manipulates data to perform the operations of the computer (702) and any algorithms, methods, functions, processes, flows, and procedures as described in the instant disclosure.

The computer (702) also includes a memory (706) that holds data for the computer (702) or other components (or a combination of both) that can be connected to the network (730). For example, memory (706) can be a database storing data consistent with this disclosure. Although illustrated as a single memory (706) in FIG. 7, two or more memories may be used according to particular needs, desires, or particular implementations of the computer (702) and the described functionality. While memory (706) is illustrated as an integral component of the computer (702), in alternative implementations, memory (706) can be external to the computer (702).

The application (707) is an algorithmic software engine providing functionality according to particular needs, desires, or particular implementations of the computer (702), particularly with respect to functionality described in this disclosure. For example, application (707) can serve as one or more components, modules, applications, etc. Further, although illustrated as a single application (707), the application (707) may be implemented as multiple applications (707) on the computer (702). In addition, although illustrated as integral to the computer (702), in alternative implementations, the application (707) can be external to the computer (702).

There may be any number of computers (702) associated with, or external to, a computer system containing computer (702), each computer (702) communicating over network (730). Further, the term "client," "user," and other appropriate terminology may be used interchangeably as appropriate without departing from the scope of this disclosure. Moreover, this disclosure contemplates that many users may use one computer (702), or that one user may use multiple computers (702).

In some embodiments, the computer (702) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, a cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed:

1. A system, comprising:

a control system disposed on a well surface;

a casing disposed in a wellbore;

a first electrical wiring coupled to the control system and the casing within a first section of the wellbore;

a second electrical wiring coupled to a plurality of flow control devices in a second section of the wellbore, wherein the first section of the wellbore is disposed at a first predetermined direction that is different than a second predetermined direction of the second section of the wellbore; and an electrical connector coupled to the first electrical wiring and the second electrical wiring, wherein the electrical connector comprises:

a mechanical receiver that couples with the first electrical wiring, and a stinger assembly coupled with the second electrical wiring and configured to connect to the mechanical receiver, wherein the electrical connector further comprises:

a latch; and a spring actuator coupled to the latch, wherein the latch is configured to require a predetermined tensile force for removal of the stinger assembly from the mechanical receiver.

2. The system of claim 1, wherein the electrical connector further comprises:

a sealed case.

3. The system of claim 1, wherein the stinger assembly comprises a snap-in-rotate-out stinger.

4. The system of claim 1, wherein the first electrical wiring is coupled to the control system using an electric line extraction tool, and wherein the electric line extraction tool comprises a hook assembly, an extension arm, a display device, and an input device configured for controlling the hook assembly and the extension arm using one or more user inputs.

5. The system of claim 1, wherein the first section of the wellbore corresponds to a vertical well path through a subsurface, wherein the second section of the wellbore corresponds to a horizontal well path through the subsurface, and wherein the plurality of flow control devices are disposed in the second section of the wellbore during one or more well completion operations.

6. The system of claim 1, wherein a flow control device among the plurality of flow control devices is selected from a group consisting of an inflow control device (ICD), an autonomous inflow control device (AICD), and an autonomous inflow control valve (AICV), and wherein the flow control device comprises one or more sensors that are selected from a group consisting of a flow meter, a phase saturation sensor, a phase velocity sensor, a pressure sensor, and a temperature sensor.

7. The system of claim 1, further comprising:

a casing centralizer disposed in the first section of the wellbore, wherein the casing centralizer is configured to dispose the casing at a predetermined distance from a wall of the wellbore; and a titanium conduit coupled to the casing centralizer and comprising the first electrical wiring, wherein the casing centralizer is configured to allow passage of the titanium conduit and the first electrical wiring through the casing centralizer.

8. The system of claim 1, further comprising:

a casing shoe coupled to the casing and disposed in the wellbore, wherein the electrical connector is disposed between the casing shoe and the well surface.

9. The system of claim 1, further comprising:

a liner assembly comprising a liner and a liner hanger coupled to the liner, wherein the second electrical wiring is disposed in the liner in the second section of the wellbore, and wherein the electrical connector is disposed between the liner hanger and a casing shoe.

10. The system of claim 1, further comprising:

a reservoir simulator coupled to the control system, wherein the control system is configured to store sensor data regarding the plurality of flow control devices, and wherein the reservoir simulator is configured to perform one or more reservoir simulations that describe changes in one or more pressure drops across one or more flow control devices.

11. The system of claim 1, further comprising:

a plurality of sensor devices disposed along the second section of the wellbore; and a production tree coupled the wellbore, wherein the control system is configured to:

store sensor data regarding the plurality of sensor devices, determine, using the sensor data, a change in reservoir pressure for a geological region of interest comprising the wellbore, and transmit one or more commands to adjust one or more parameters of one or more production operations based on the sensor data.

12. The apparatus of claim 1, wherein the stinger assembly comprises a stinger selected from a group consisting of a snap-in-snap-out stinger and a bullnose stinger.

13. A method, comprising:

obtaining, by a control system and using an electrical connector coupled to a plurality of sensor devices disposed in a wellbore, first sensor data regarding a geological region of interest, wherein the wellbore comprises a first section comprising a first electrical wiring coupled to the control system through a wellhead and a second section comprising a second electrical wiring coupled to the plurality of sensor devices, wherein the electrical connector comprises a mechanical receiver coupled to the first electrical wiring and a stinger assembly coupled with the second electrical wiring, wherein the electrical connector further comprises:

a latch; and a spring actuator coupled to the latch, wherein the latch is configured to require a predetermined tensile force for removal of the stinger assembly from the mechanical receiver, and wherein the first section of the wellbore is disposed at a first predetermined direction that is different than a second predetermined direction of the second section of the wellbore; and transmitting, using the control system, a command to a well device based on the first sensor data.

14. The method of claim 13, further comprising:

perform a reservoir simulation for a geological region of interest using the first sensor data; and determining a predicted production rate for one or more wells in the geological region of interest using the reservoir simulation.

15. The method of claim 13, wherein the command changes one or more production parameters of a production operation at the wellbore.

16. The method of claim 13, further comprising:

obtaining, by the control system and using the electrical connector, second sensor data regarding a plurality of flow control devices in the wellbore; and determining, by the control system and using the second sensor data, whether a phase breakthrough has occurred in the wellbore among the plurality of flow control devices.

17. The method of claim 16, wherein a flow control device among the plurality of flow control devices is selected from a group consisting of an inflow control device (ICD), an autonomous inflow control device (AICD), and an autonomous inflow control valve (AICV), and wherein the flow control device comprises one or more sensors that are selected from a group consisting of a flow meter, a phase saturation sensor, a phase velocity sensor, a pressure sensor, and a temperature sensor.

18. The method of claim 13, wherein the first section of the wellbore corresponds to a vertical well path through a subsurface, wherein the second section of the wellbore corresponds to a horizontal well path through the subsurface, and wherein the plurality of sensor devices are disposed in the second section of the wellbore after one or more well completion operations.

* * * * *